US011585031B2

(12) United States Patent
Herschler et al.

(10) Patent No.: US 11,585,031 B2
(45) Date of Patent: Feb. 21, 2023

(54) WASHING MACHINE APPLIANCE HAVING A RETRACTABLE AGITATION ELEMENT

(71) Applicant: Haier US Appliance Solutions, Inc., Wilmington, DE (US)

(72) Inventors: Brad Herschler, Louisville, KY (US); Eric Gerard Johnson, New Albany, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/177,527

(22) Filed: Feb. 17, 2021

(65) Prior Publication Data

US 2022/0259784 A1 Aug. 18, 2022

(51) Int. Cl.

| | |
|---|---|
| ***D06F 21/14*** | (2006.01) |
| ***D06F 13/06*** | (2006.01) |
| ***D06F 37/40*** | (2006.01) |
| ***D06F 21/08*** | (2006.01) |
| ***D06F 37/12*** | (2006.01) |

(52) U.S. Cl.

CPC ..... *D06F 21/14* (2013.01); *D06F 13/06* (2013.01); *D06F 21/08* (2013.01); *D06F 37/12* (2013.01); *D06F 37/40* (2013.01)

(58) Field of Classification Search

CPC ..... D06F 13/00; D06F 13/02; D06F 13/04; D06F 13/06; D06F 21/14

See application file for complete search history.

(56) References Cited

U.S. PATENT DOCUMENTS

| | | | | |
|---|---|---|---|---|
| 2,092,954 | A | 9/1937 | Carter | |
| 3,399,552 | A | 9/1968 | Cobb | |
| 4,068,503 | A * | 1/1978 | Platt | D06F 13/00 68/133 |
| 4,170,882 | A | 10/1979 | Brenner | |
| 4,193,275 | A * | 3/1980 | Bochan | D06F 13/00 68/134 |
| 4,520,638 | A * | 6/1985 | Brenner | D06F 13/06 68/133 |
| 5,675,996 | A | 10/1997 | Cho | |
| 7,069,752 | B2 | 7/2006 | Clark | |
| 2017/0260673 | A1* | 9/2017 | Obregon | D06F 17/10 |
| 2021/0062382 | A1* | 3/2021 | Andrejczuk | D06F 17/10 |

FOREIGN PATENT DOCUMENTS

| | | |
|---|---|---|
| BR | 102012001746 A2 | 9/2013 |
| CN | 101191290 B | 7/2011 |
| WO | WO2012113050 A2 | 8/2012 |

* cited by examiner

*Primary Examiner* — Joseph L. Perrin
(74) *Attorney, Agent, or Firm* — Dority & Manning, P.A.

(57) ABSTRACT

A washing machine appliance may include a tub, a basket, and a retractable agitation element. The basket may be rotatably positioned within the tub. The retractable agitation element may be positioned within the basket. The retractable agitation element may define a rotation axis. The retractable agitation element may include a lower shaft, an upper shaft, and a resilient fin. The upper shaft may be slidably mounted on lower shaft in telescoping cooperation to move axially along the rotation axis. The resilient fin may be movably attached to the lower shaft apart from the upper shaft.

14 Claims, 8 Drawing Sheets

WASHING MACHINE APPLIANCE HAVING A RETRACTABLE AGITATION ELEMENT

FIELD OF THE INVENTION

The present subject matter relates generally to washing machine appliances and an agitation element for the same.

BACKGROUND OF THE INVENTION

A vertical axis washing machine appliance generally includes a tub with a basket rotatably positioned within the tub. Articles to be washed, such as clothes, are placed in the machine's basket. An agitation element can be included in the tub, and can rotate to move articles within the basket to facilitate washing. Agitation elements are typically impellers, single-action agitation elements, or dual-action agitation elements. Generally, such an agitation element reciprocates about a rotation axis (e.g., vertical axis) within the machine's basket. In some instances, fins extend from a rigid shaft of the agitation element to contact and move the articles. The surface of the basket and gravity may be used in conjunction with such agitation elements to impart a circular motion of the articles, known as "turnover," from a top of the basket, to a bottom of the basket, and back up to the top of the basket.

Different agitation elements typically come with different advantages and disadvantages. In the case of single-action and dual-action agitation elements, users may perceive greater agitation and turnover of articles during a washing operation or cycle than with an impeller agitation element. In the case of impeller agitation elements, a greater volume or portion of the wash basket may be available or better able to handle bulky items (e.g., towels, bedding, etc.) than a single-action or dual-action agitation element.

Generally, a consumer or user has to decide which type of agitation element would be most desired at the time of purchase. This obviously limits the user's choice and ability to wash various loads. As a result, it would be useful if a user could have greater flexibility, particularly with regard to the type of agitation element that is used for any given washing operation or wash cycle. Therefore, it would be advantageous to provide a washing machine appliance or assembly wherein an agitation element could be readily altered (e.g., expanded, contracted, removed, etc.) between discrete washing operations or wash cycles.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance may include a tub, a basket, and a retractable agitation element. The basket may be rotatably positioned within the tub. The retractable agitation element may be positioned within the basket. The retractable agitation element may define a rotation axis. The retractable agitation element may include a lower shaft, an upper shaft, and a resilient fin. The upper shaft may be slidably mounted on lower shaft in telescoping cooperation to move axially along the rotation axis. The resilient fin may be movably attached to the lower shaft apart from the upper shaft.

In another exemplary aspect of the present disclosure, a washing machine appliance is provided. The washing machine appliance may include a tub, a basket, an impeller base, and a retractable agitation element. The basket may be rotatably positioned within the tub. The impeller base may be rotatably mounted within the basket. The retractable agitation element may be positioned within the basket. The retractable agitation element may define a rotation axis. The retractable agitation element may include a lower shaft, an upper shaft, and a resilient fin. The upper shaft may be slidably mounted on lower shaft in telescoping cooperation to move axially along the rotation axis. The resilient fin may be movably attached to the lower shaft apart from the upper shaft. The resilient fin may be selectively compressed with the upper and lower shafts between a vertically collapsed state and a vertically expanded state.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
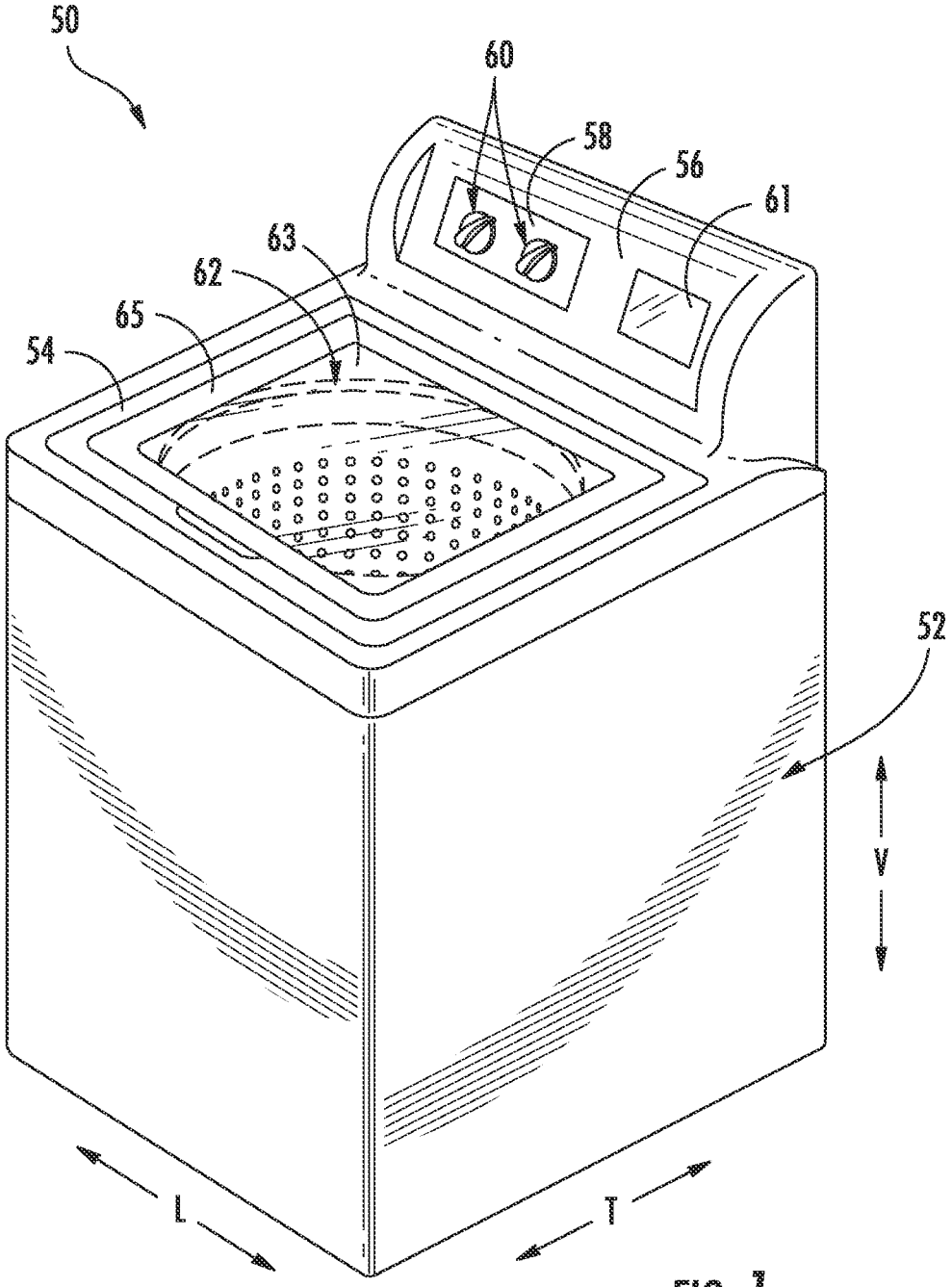
FIG. 1 provides a perspective view of a washing machine appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The phrase "in one embodiment," does not necessarily refer to the same embodiment, although it may. The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
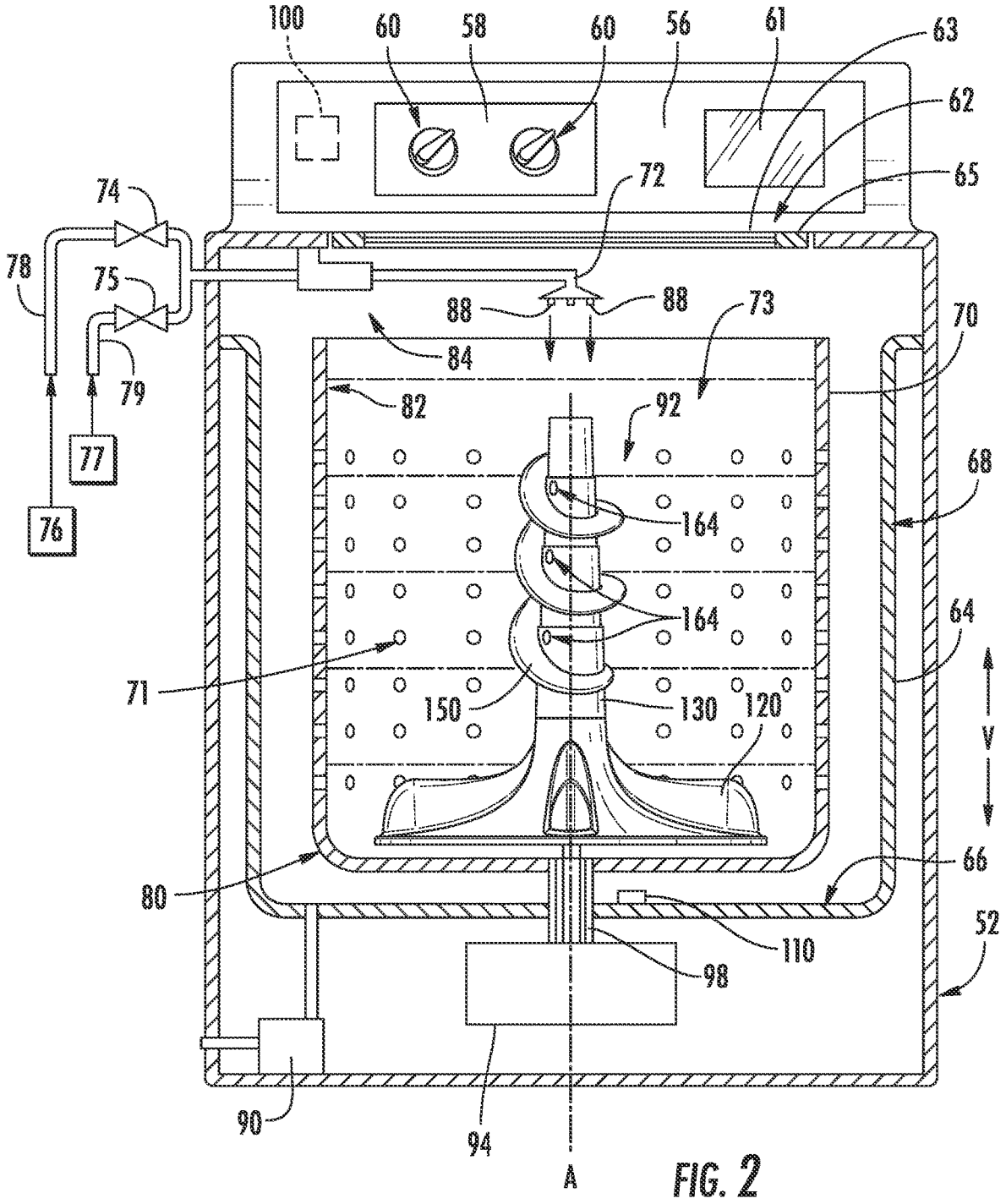
FIG. 2 provides a sectional elevation view of the exemplary washing machine appliance of FIG. 1.
Figure 3:
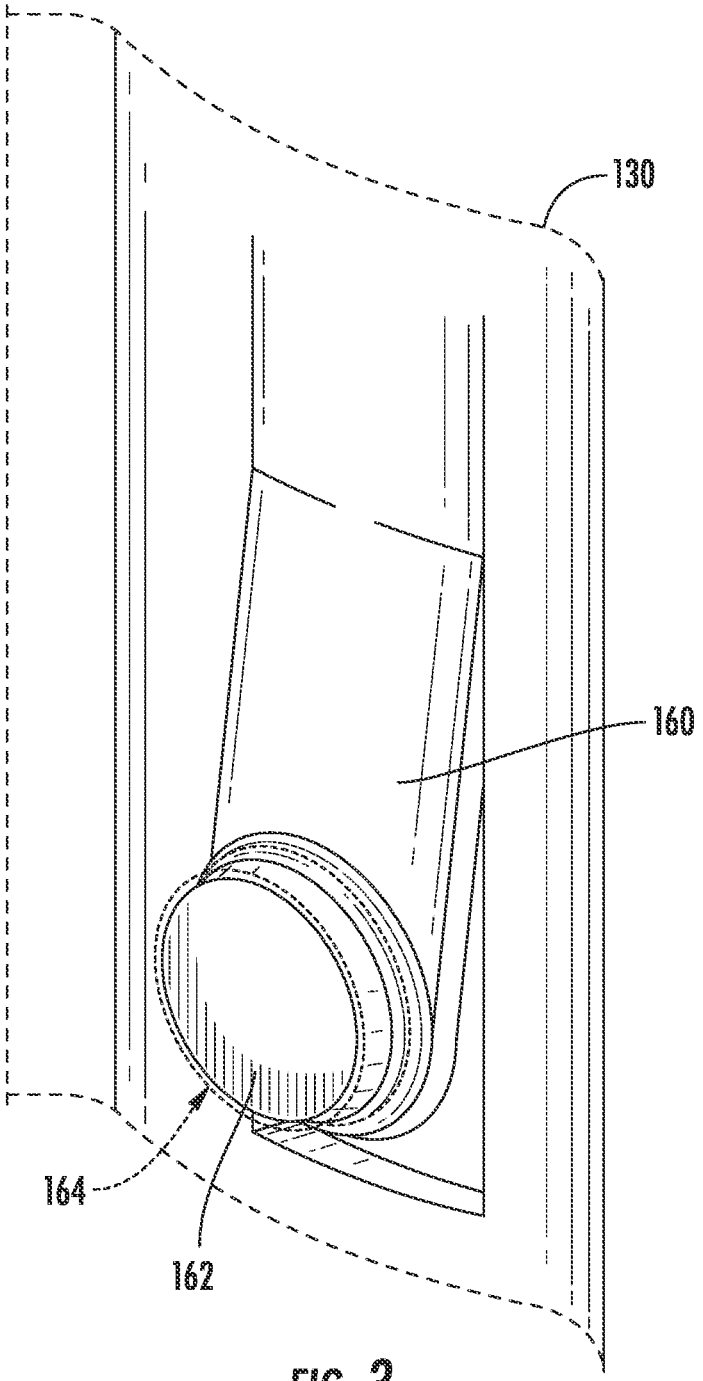
FIG. 3 provides a perspective view of a portion of the agitation element of the exemplary washing machine appliance of FIG. 1.
Figure 4:
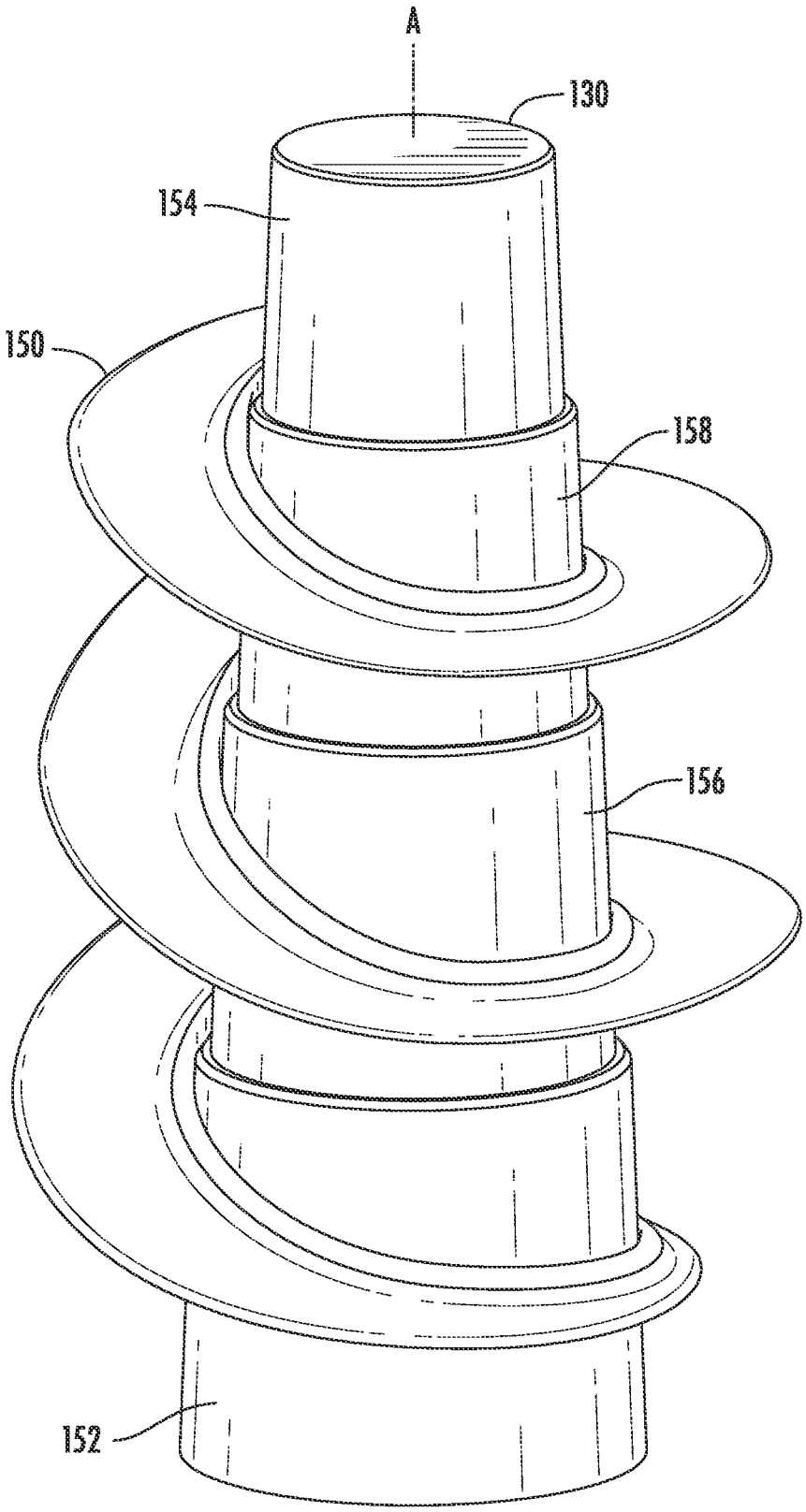
FIG. 4 provides a perspective view of another portion of the agitation element of the exemplary washing machine appliance of FIG. 1.
Figure 5:
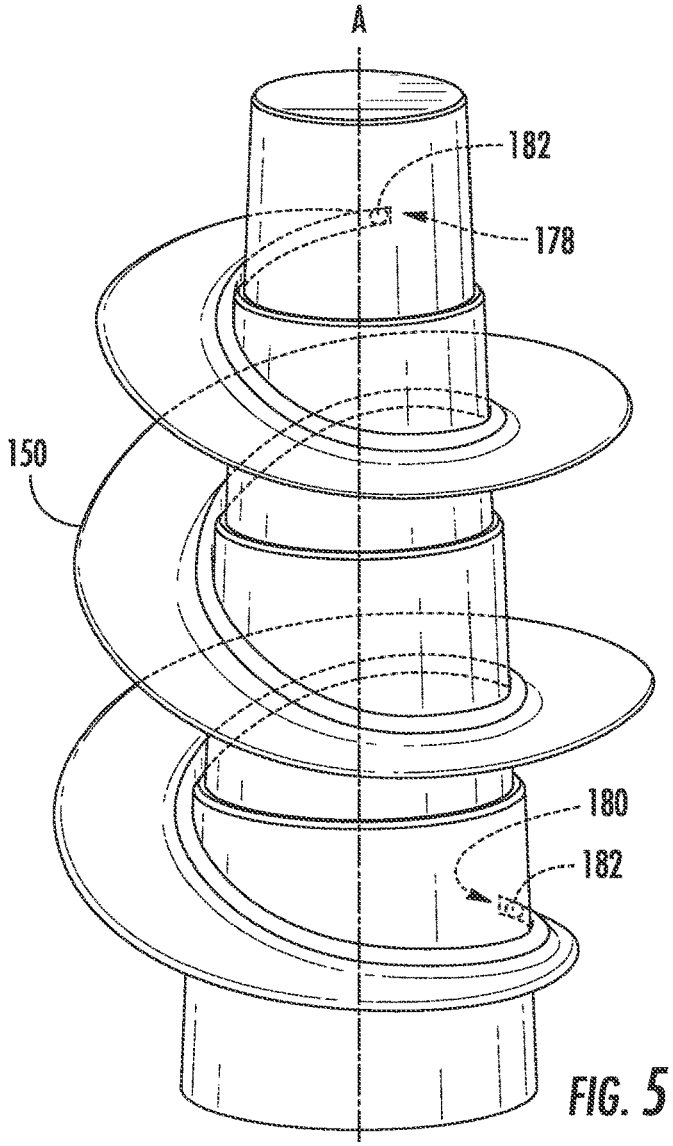
FIG. 5 provides a perspective view of an agitation element and radial fin of the exemplary washing machine appliance of FIG. 1 in an expanded state.

Turning now to the figures, FIGS. 1 and 2 provide separate views of a washing machine appliance 50 according to exemplary embodiments of the present disclosure. As shown, washing machine appliance 50 generally defines a vertical direction V, a lateral direction L, and a transverse direction T. The vertical direction V, lateral direction L, and transverse direction T are each mutually perpendicular and form an orthogonal direction system.

Washing machine appliance 50 may include a cabinet 52 and a cover 54. A backsplash 56 extends from cover 54, and a control panel 58, including a plurality of input selectors 60, is coupled to backsplash 56.

Control panel 58 and input selectors 60 collectively form a user interface input for operator selection of machine cycles and features, and in one embodiment, a display 61 indicates selected features, a countdown timer, or other items of interest to machine users. It should be appreciated, however, that in other exemplary embodiments, the control panel 58, input selectors 60, and display 61, may have any other suitable configuration. For example, in other exemplary embodiments, one or more of the input selectors 60 may be configured as manual "push-button" input selectors, or alternatively may be configured as a touchscreen (e.g., on display 61).

A lid 62 may be mounted to cover 54 and rotatable between an open position (not shown) facilitating access to a tub, also referred to as a wash tub, 64 located within cabinet 52 and a closed position (FIG. 1) forming an enclosure over tub 64. Lid 62 in exemplary embodiment includes a transparent panel 63, which may be formed of, for example, glass, plastic, or any other suitable material. The transparency of the panel 63 allows users to see through the panel 63, and into the tub 64 when the lid 62 is in the closed position. In some embodiments, the panel 63 itself can generally form the lid 62. In other embodiments, the lid 62 includes the panel 63 and a frame 65 surrounding and encasing the panel 63. Alternatively, panel 63 need not be transparent.

As may be seen in FIG. 2, tub 64 includes a bottom wall 66 and a sidewall 68. A wash drum or basket 70 is rotatably mounted within tub 64. In particular, basket 70 is rotatable about a central axis, which may when properly balanced and positioned in the embodiment illustrated be a vertical axis. Thus, washing machine appliance is generally referred to as a vertical axis washing machine appliance. Basket 70 defines a wash chamber 73 for receipt of articles for washing and extends, for example, vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent to top portion 82 of basket 70. Nozzle 72 may be in fluid communication with one or more water sources 76, 77 in order to direct liquid (e.g. water) into tub 64 or onto articles within chamber 73 of basket 70. Nozzle 72 may further include apertures 88 through which water may be sprayed into the tub 64. Apertures 88 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed (i.e. sprayed or poured) into the tub 64.

Various valves may regulate the flow of fluid through nozzle 72. For example, a flow regulator may be provided to control a flow of hot or cold water into the wash chamber of washing machine appliance 50. For the embodiment depicted, the flow regulator includes a hot water valve 74 and a cold water valve 75. The hot and cold water valves 74, 75 are used to flow hot water and cold water, respectively, therethrough. Each valve 74, 75 can selectively adjust to a closed position in order to terminate or obstruct the flow of fluid therethrough to nozzle 72. The hot water valve 74 may be in fluid communication with a hot water source 76, which may be external to the washing machine appliance 50. The cold water valve 75 may be in fluid communication with a cold water source 77, which may be external to the washing machine appliance 50. The cold water source 77 may, for example, be a commercial water supply, while the hot water source 76 may be, for example, a water heater. Such water sources 76, 77 may supply water to the appliance 50 through the respective valves 74, 75. A hot water conduit 78 and a cold water conduit 79 may supply hot and cold water, respectively, from the sources 76, 77 through the respective valves 74, 75 and to the nozzle 72.

An additive dispenser 84 may additionally be provided for directing a wash additive, such as detergent, bleach, liquid fabric softener, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. For the embodiment depicted, nozzle 72 is a separate downstream component from dispenser 84. In other exemplary embodiments, however, nozzle 72 and dispenser 84 may be integral, with a portion of dispenser 84 serving as the nozzle 72, or alternatively dispenser 84 may be in fluid communication with only one of hot water valve 74 or cold water valve 75. In still other exemplary embodiments, the washing machine appliance 50 may not include a dispenser, in which case a user may add one or more wash additives directly to wash chamber 73. A pump assembly 90 (shown schematically in FIG. 2) is located beneath tub 64 and basket 70 for gravity assisted flow to drain tub 64.

As will be described in greater detail herein, an agitation element 92 is oriented to rotate about a rotation axis A (e.g., parallel to the central axis or vertical direction V). Generally, agitation element 92 includes an impeller base 120 and extended post 130. The agitation element 92 depicted is positioned within the basket 70 to impart motion to the articles and liquid in the chamber 73 of the basket 70. More particularly, the agitation element 92 depicted is provided to impart downward motion of the articles along the vertical direction V. For example, with such a configuration, during operation of the agitation element 92 the articles may be moved downwardly along the vertical direction V at a center of the basket 70, outwardly from the center of basket 70 at the bottom portion 80 of the basket 70, then upwardly along the vertical direction V towards the top portion 82 of the basket 70.

In optional embodiments, basket 70 and agitation element 92 are both driven by a motor 94. Motor 94 may, for example, be a pancake motor, direct drive brushless motor, induction motor, or other motor suitable for driving basket 70 and agitation element 92. As motor output shaft 98 is rotated, basket 70 and agitation element 92 are operated for rotatable movement within tub 64 (e.g., about rotation axis A). Washing machine appliance 50 may also include a brake assembly (not shown) selectively applied or released for respectively maintaining basket 70 in a stationary position within tub 64 or for allowing basket 70 to spin within tub 64.

Various sensors may additionally be included in the washing machine appliance 50. For example, a pressure sensor 110 may be positioned in the tub 64 as illustrated or, alternatively, may be remotely mounted in another location within the appliance 50 and be operationally connected to tub 64 by a hose (not shown). Any suitable pressure sensor 110, such as an electronic sensor, a manometer, or another suitable gauge or sensor, may be used. The pressure sensor 110 may generally measure the pressure of water in the tub 64. This pressure can then be used to estimate the height or amount of water in the tub 64. Additionally, a suitable speed sensor can be connected to the motor 94, such as to the output shaft 98 thereof, to measure speed and indicate operation of the motor 94. Other suitable sensors, such as temperature sensors, water sensors, moisture sensors, etc., may additionally be provided in the washing machine appliance 50.

Operation of washing machine appliance 50 is controlled by a processing device or controller 100, that is operatively coupled to the input selectors 60 located on washing machine backsplash 56 for user manipulation to select washing machine cycles and features. Controller 100 may further be operatively coupled to various other components of appliance 50, such as the flow regulator (including valves 74, 75), motor 94, pressure sensor 110, other suitable sensors, etc. In response to user manipulation of the input selectors 60, controller 100 may operate the various components of washing machine appliance 50 to execute selected machine cycles and features.

While described in the context of specific embodiments of washing machine appliance 50, using the teachings disclosed herein it will be understood that washing machine appliance 50 is provided by way of example only. Other washing machine appliances having different configurations, different appearances, or different features may also be used with the present subject matter as well.

Turning now generally to FIGS. 2 through 7, agitation element 92 may include or be provided as a retractable agitation element having an extended post 130 and one or more fins 150 extending radially therefrom. When assembled, extended post 130 may generally extend along and telescope (e.g., expand/collapse) along the rotation axis A from a top end to a bottom end. Specifically, a bottom shaft 152 may be connected to one or more secondary shafts (e.g., top shaft 154 or middle shafts 156, 158) that are mounted on bottom shaft 152 in telescoping cooperation to move axially (i.e., up and down) along the rotation axis A. Given the telescoping arrangement, bottom shaft 152 may receive or be received by the secondary shafts (e.g., when collapsed). Thus, bottom shaft 152 may define a larger (or, alternatively, smaller) outer diameter than the secondary shafts. Similarly, each sequential secondary shaft may define a larger, (or alternatively, smaller) outer diameter than the subsequent secondary shaft. In the illustrated embodiments, bottom shaft 152 defines a larger outer diameter than both middle shafts 156, 158 and top shaft 154; first middle shaft 156 defines a larger outer diameter than second middle shaft 158; and second middle shaft 158 defines a larger outer diameter than top shaft 154.

As would be understood, any relatively larger-diameter shaft may be hollow to receive one or more relatively smaller-diameter shafts (e.g., in a nested arrangement). During use, and specifically prior to or after a washing operation, a user may thus expand or collapse the extended post 130 within wash chamber 73. Specifically, top shaft 154 may be drawn (e.g., upward) to extend from or otherwise be held above bottom shaft 152 (e.g., and middle shafts 156, 158).

Generally, any suitable mechanical retention assembly may be provided for holding extended post 130 in the expanded state. Specifically, any releasable mechanical fastener or assembly may be provided to hold the shafts at one or more predetermined positions relative to each other. Such fasteners or assemblies may be manually actuated (e.g., by a user) or automatically driven by one or more internal motors (e.g., as directed by the controller 100). In the illustrated embodiments, a resilient prong 160 is provided on (e.g., formed with) one or more secondary shafts to selectively engage or be held within a corresponding aperture 164 defined through the adjacent nested shaft (e.g., bottom shaft 152 or middle shaft 156, 158 in which middle shaft 156, 158 or top shaft 154 is nested in, respectively). A resilient prong 160 may be provided with a raised or undercut tab 162 biased towards and sized to fit into a corresponding aperture 164 on the same face of the telescopic shaft immediately adjacent and below the shaft on which resilient prong 160 is provided. Thus, the resilient prong 160 of each shaft is locked in the aperture 164 of the adjacent telescopic shaft when the extended post 130 is expanded, such as when a user pulls the top shaft 154 or middle shaft 156, 158 upwards. The unlocking of the shafts may be manual. For instance, the user may press the resilient prong 160 (e.g., at the raised or undercut tab 162) to move it from the corresponding aperture 164, releasing one shaft from the other and allowing them to disconnect and be moved downward to collapse near the impeller base 120.

Figure 8:
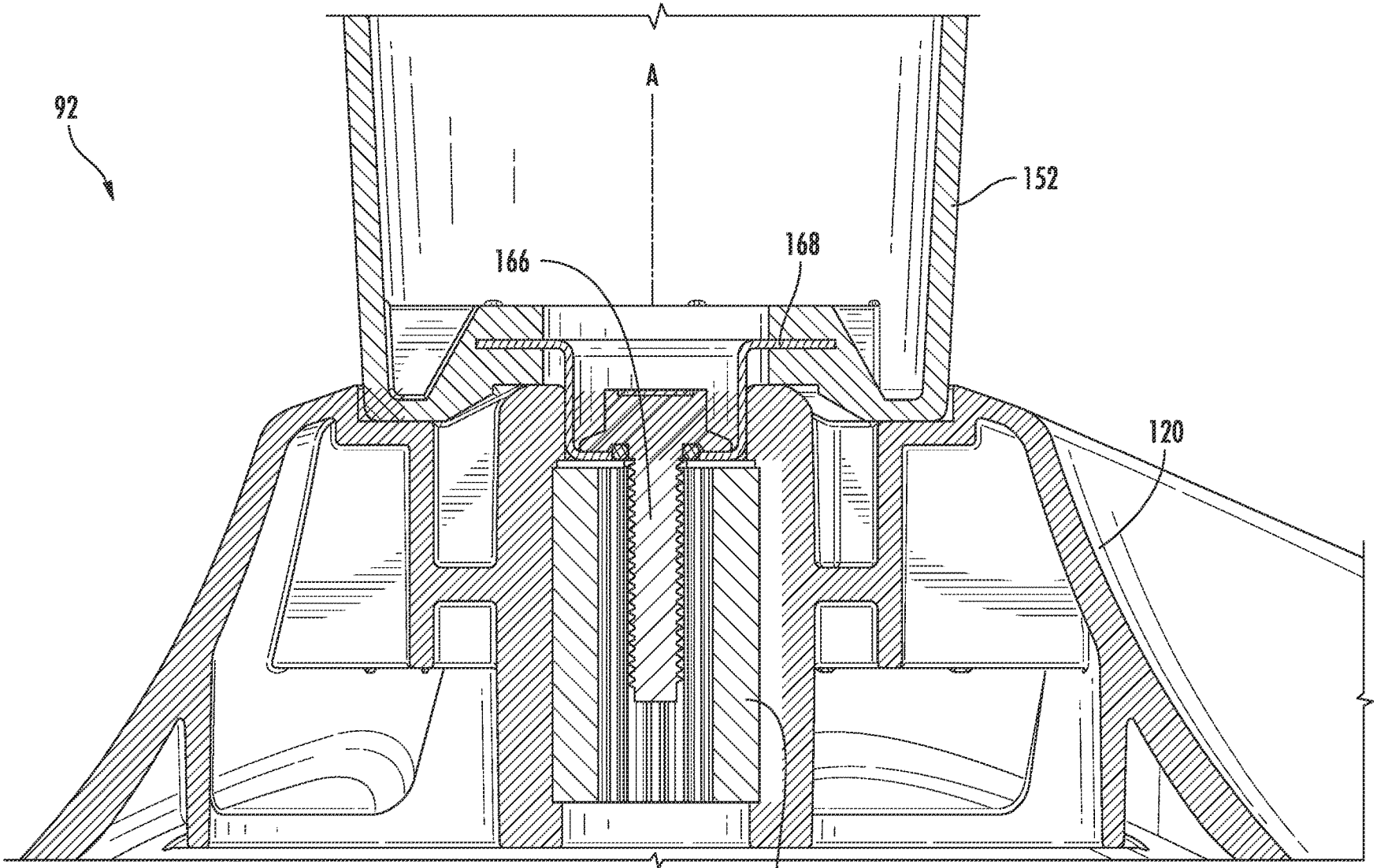
FIG. 8 provides a magnified sectional view of a connection between an agitator shaft and impeller base according to exemplary embodiments of the present disclosure.
Figure 9:
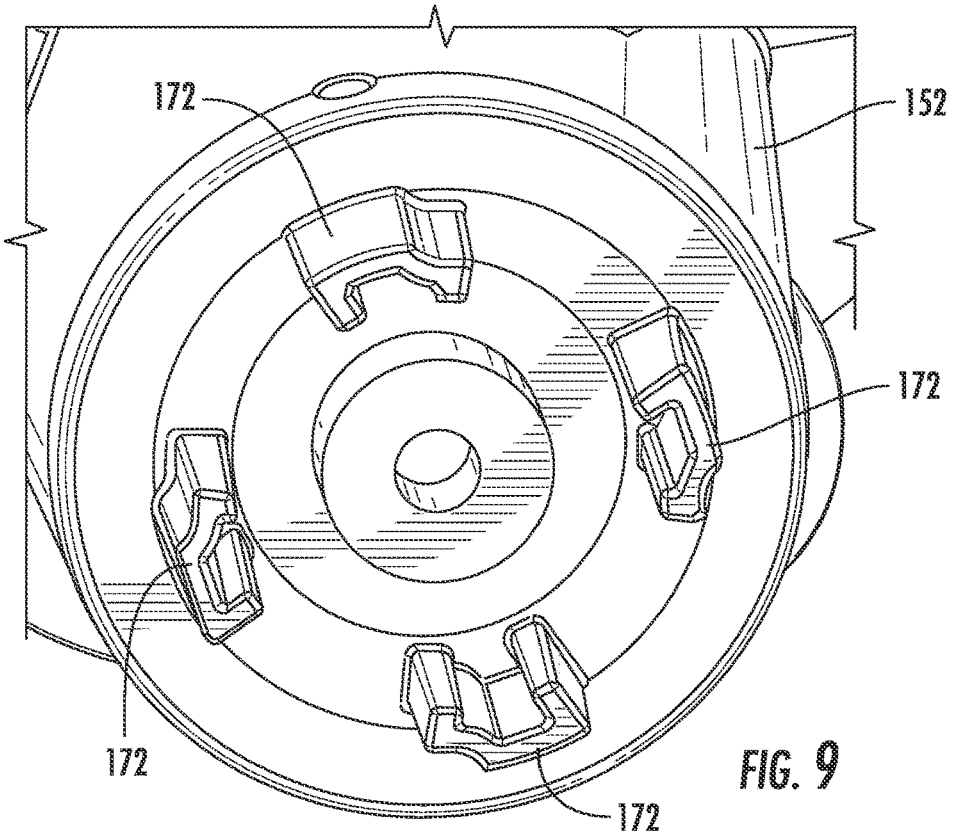
FIG. 9 provides a bottom perspective view of a portion of an exemplary agitator shaft.
Figure 10:
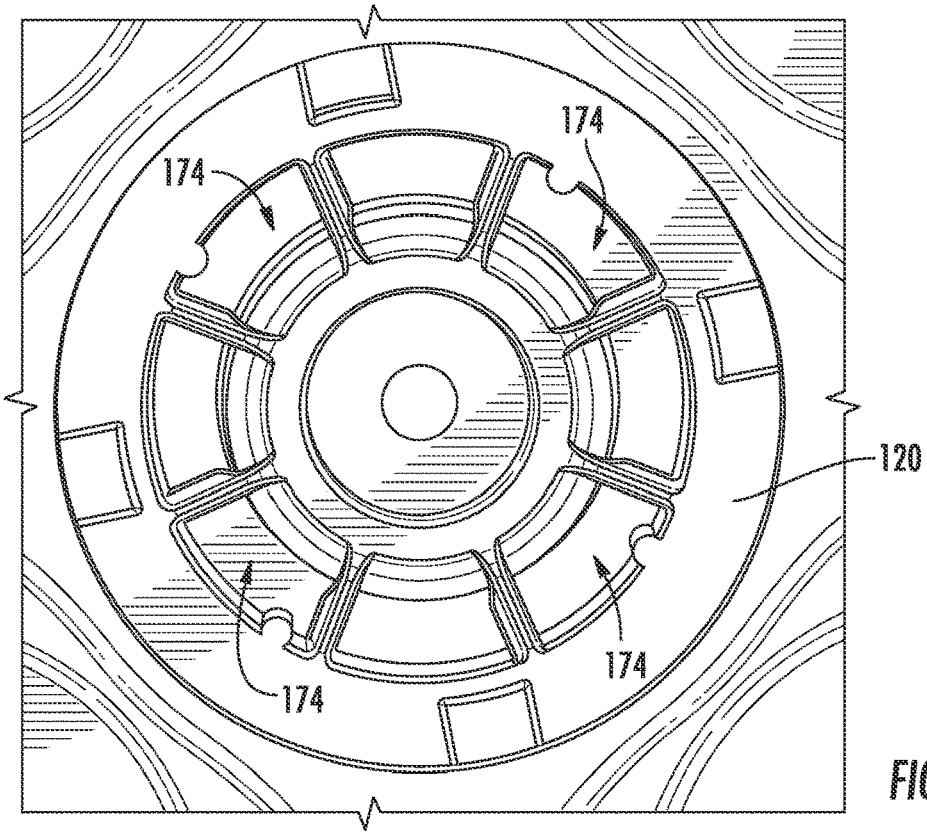
FIG. 10 provides a top perspective view of a portion of an exemplary impeller base.

Turning briefly to FIGS. 8 through 10, an impeller base 120 may be provided (e.g., below extended post 130) in mechanical communication with motor 94 (FIG. 2). When assembled, extended post 130 may be mounted or rotationally fixed to impeller base 120. Specifically, bottom shaft 152 may be attached to impeller base 120. Due to the rotational fixture, bottom shaft 152 (and extended post 130 generally) may be rotated with impeller base 120 as driven by motor 94.

In optional embodiments, a user can selectively remove extended post 130 from impeller base 120. Thus, bottom shaft 152 (and extended post 130 generally) may be removably fixed to impeller base 120. For instance, one or more mechanical fasteners (e.g., screws, clips, bolts, etc.) may selectively hold bottom shaft 152 and extended post 130 to impeller base 120. In the illustrated embodiments, a central bolt 166 extends along the rotation axis A to hold an overmolded bottom bracket 168 of bottom shaft 152 against a mating collar 170 at the top of impeller base 120. The central bolt 166 may maintain extended post 130 at a fixed vertical position relative to impeller base 120. Moreover, a plurality of vertical (e.g., C-shaped) teeth 172 are circumferentially spaced apart from each other about the rotation axis A on the bottom of bottom shaft 152 (e.g., such that the opening of the C-shape is directed toward rotation axis A). A plurality of receiver slots 174 defined on impeller base 120 may face upward and correspond to the vertical teeth 172. In turn, each vertical tooth 172 may be received in a discrete receiver slot 174 when extended post 130 is mounted to impeller base 120 to maintain extended post 130 at a fixed rotational position relative to impeller base 120 (e.g., to rotate therewith)

Turning especially to FIGS. 2 and 4 through 6, at least one resilient fin 150 may extend radially outward from extended post 130. Specifically, resilient fin 150 may be attached to one or more of the shafts (e.g., to move therewith). In certain embodiments, resilient fin 150 includes a helical coil wrapped about multiple shafts. For instance, the resilient fin 150 may form multiple passes that surround extended post 130 between the top end and the bottom end of extended post 130. Thus, resilient fin 150 may extend about the rotation axis A in a helix from an upper tip 178 to a lower tip 180.

Figure 6:
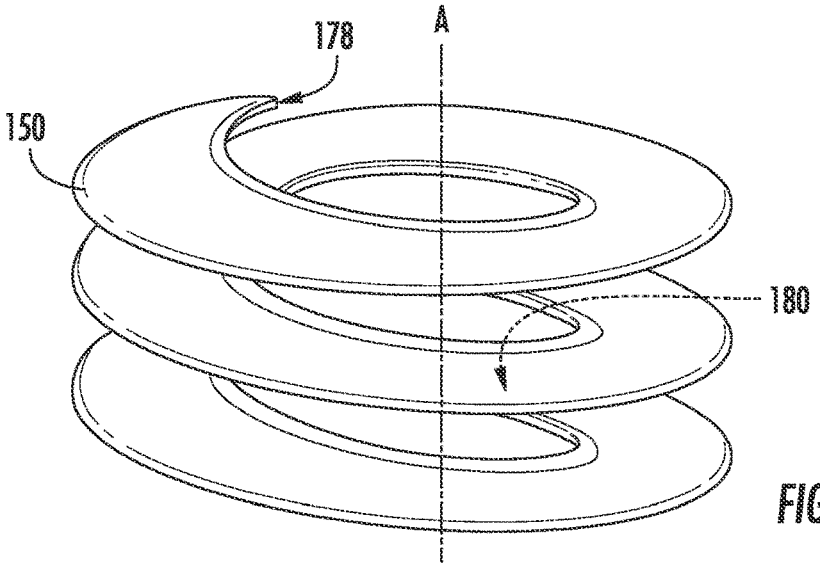
FIG. 6 provides a perspective view of a radial fin of the exemplary agitation element in a retracted state.

When assembled, resilient fin 150 may move with extended post 130 between the expanded state (e.g., FIG. 5) and the collapsed state (e.g., FIG. 6). In some embodiments, resilient fin 150 is movably mounted to one or more shafts (e.g., 152, 154, 156, 158) of the extended post 130 to facilitate the expansion/collapse of resilient fin 150. For instance, resilient fin 150 may be slidably or pivotally mounted on a groove or mounting bracket 182 of one or more shafts. For instance, a mated pivoting pin-slot connection, which is generally understood in the art, may be formed between resilient fin 150 and at least one shaft (e.g., 152, 154, 156, 158). In some such embodiments, resilient fin 150 is attached both to a relatively low or lower shaft (e.g., bottom shaft 152) and a relatively high or upper shaft (e.g., top shaft 154). Additionally or alternatively, resilient fin 150 may be attached to one or more intermediate shafts (e.g., first or second middle shaft 156, 158). Generally, resilient fin 150 is formed from one or more elastic materials (e.g., a solid flexible polymer, a hollow polymer, a polymer embedded with one or more framing wires from upper tip 178 to lower tip 180, etc.). Thus, resilient fin 150 may be permitted to deform and selectively compress with the extended post 130 as it is moved between the expanded state and the collapsed state. Furthermore, the collapsed state can provide the upper and lower tips 178, 180 in closer proximity than the expanded state.

Figure 7:
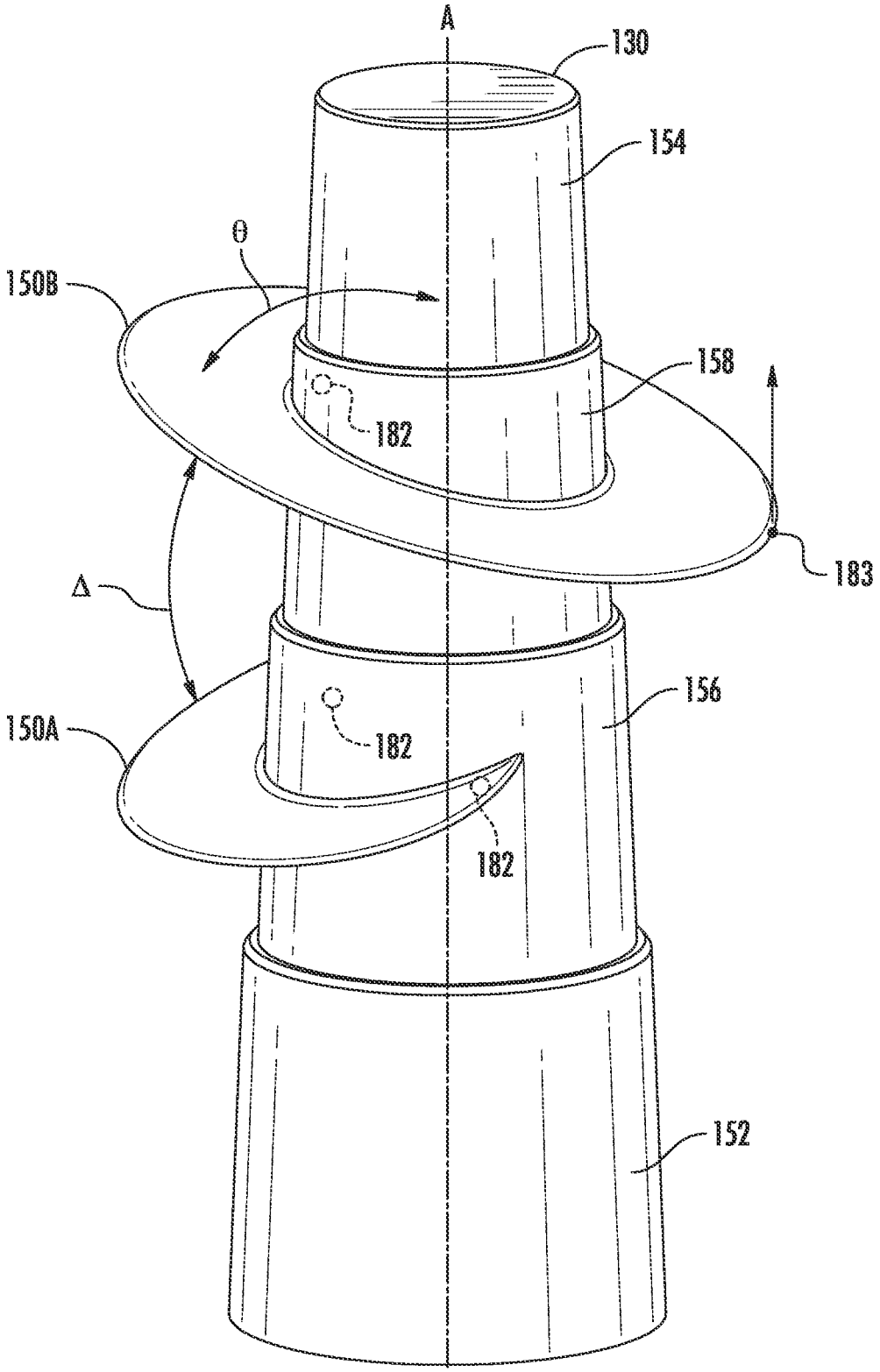
FIG. 7 provides a perspective view of a portion of an agitation element of a washing machine appliance according to exemplary embodiments of the present disclosure.

Turning especially to FIG. 7, in alternative embodiments, multiple resilient fins 150 (e.g., a first fin 150A and a second fin 150B) may extend radially outward from extended post 130. For instance, a first fin 150A may be attached to one or more of the shafts, such as first middle shaft 156 (e.g., to move therewith). Second fin 150B may be attached to a separate shaft, such as second middle shaft 158 (e.g., to move therewith). In certain embodiments, first and second fins 150A, 150B are vertically spaced apart and discontinuous with each other. One or more of the resilient fins 150A, 150B may be mounted at a non-orthogonal angle θ relative to the rotation axis A. Second fin 150B, in particular, may provide an askew disc that is neither perpendicular nor parallel to rotation axis A. Optionally, in the expanded state, first fin 150A may provide a semi-circular arc that is non-parallel to second fin 150B (e.g., non-orthogonal to rotation axis A), as shown. Additionally or alternatively, first fin 150A may be movable (e.g., pivotable) relative to the second fin 150B to define a variable angle A with the second fin 150B. In some such embodiments, first fin 150A is pivotally mounted to one shaft (e.g., first middle shaft 156). In some such embodiments, first fin 150A is pivotally mounted such that at least one fin tip (e.g., a bottom tip) is moved (e.g., up) when in the retracted state. Optionally, second fin 150B may also be pivotally mounted to a separate shaft (e.g., second middle shaft 158) such that at least one fin tip 183 is moved (e.g., up) when in the retracted state. Alternatively, second fin 150B may be fixedly mounted to the separate shaft (e.g., second middle shaft 158). Such pivotable mounting may be facilitated, for instance, by a mounting bracket 182 including a mated pivoting pin-slot connection, which is generally understood in the art, formed between first fin 150A or second fin 150B and the corresponding shaft (e.g., first middle shaft 156 or second middle shaft 158, respectively).

Generally, each fin (e.g., first fin 150A and second fin 150B) is formed from one or more elastic materials (e.g., a solid flexible polymer, a hollow polymer, a polymer embedded with one or more framing wires).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:
a tub;
a basket rotatably positioned within the tub; and
a retractable agitation element positioned within the basket, the retractable agitation element defining a rotation axis and comprising
a lower shaft,
an upper shaft slidably mounted on lower shaft in telescoping cooperation to move axially along the rotation axis, and
a resilient fin attached to the lower shaft apart from the upper shaft,
wherein the resilient fin extends from an upper tip to a lower tip disposed below the upper tip, and
wherein the resilient fin is selectively compressed with the upper and lower shafts between a collapsed state and an expanded state, the collapsed state providing the upper and lower tips in closer proximity than the expanded state.

2. The washing machine appliance of claim 1, wherein the resilient fin is further attached to the upper shaft.

3. The washing machine appliance of claim 2, wherein the resilient fin comprises a helical coil wrapped about the upper and lower shafts.

4. The washing machine appliance of claim 1, wherein the retractable agitation element further comprises an intermediate shaft mounted between the upper and lower shafts in telescoping cooperation.

5. The washing machine appliance of claim 1, further comprising an impeller base rotatably mounted within the basket, and wherein the lower shaft is attached to the impeller base to rotate therewith.

6. The washing machine appliance of claim 5, wherein the lower shaft is removably fixed to the impeller base.

7. A washing machine appliance comprising:
a tub;

a basket rotatably positioned within the tub;

an impeller base rotatably mounted within the basket; and a retractable agitation element removably fixed to the impeller base, the retractable agitation element defining a rotation axis and comprising a lower shaft, an upper shaft slidably mounted on lower shaft in telescoping cooperation to move axially along the rotation axis, and a resilient fin attached to the lower shaft apart from the upper shaft, the resilient fin being selectively compressed with the upper and lower shafts between a vertically collapsed state and a vertically expanded state.

8. The washing machine appliance of claim 7, wherein the resilient fin is further attached to the upper shaft.

9. The washing machine appliance of claim 8, wherein the resilient fin comprises a helical coil wrapped about the upper and lower shafts.

10. The washing machine appliance of claim 7, wherein the resilient fin extends from an upper tip to a lower tip disposed below the upper tip, and wherein the resilient fin is selectively compressed with the upper and lower shafts between a collapsed state and an expanded state, the collapsed state providing the upper and lower tips in closer proximity than the expanded state.

11. The washing machine appliance of claim 7, wherein the retractable agitation element further comprises an intermediate shaft mounted between the upper and lower shafts in telescoping cooperation.

12. The washing machine appliance of claim 7, wherein the lower shaft is removably fixed to the impeller base.

13. A washing machine appliance comprising:

a tub;

a basket rotatably positioned within the tub;

an impeller base rotatably mounted within the basket; and a retractable agitation element removably fixed to the impeller base, the retractable agitation element defining a rotation axis and comprising a lower shaft removably fixed to the impeller base, an upper shaft slidably mounted on lower shaft in telescoping cooperation to move axially along the rotation axis, an intermediate shaft mounted between the upper and lower shafts in telescoping cooperation, and a resilient fin slidably or pivotably attached to the lower shaft apart from the upper shaft, the resilient fin being selectively compressed with the upper, intermediate, and lower shafts between a vertically collapsed state and a vertically expanded state.

14. The washing machine appliance of claim 13, wherein the resilient fin is further attached to the upper shaft, and wherein the resilient fin comprises a helical coil wrapped about the upper, intermediate, and lower shafts.

* * * * *